United States Patent [19]

Mellinger

[11] 3,934,593

[45] Jan. 27, 1976

[54] STRAPLESS BREAST SUPPORT

[75] Inventor: Frederick N. Mellinger, Los Angeles, Calif.

[73] Assignee: Frederick's of Hollywood, Hollywood, Calif.

[22] Filed: July 11, 1974

[21] Appl. No.: 487,707

[52] U.S. Cl. ..... 128/480; 125/505

[51] Int. Cl.[2] ..... A41C 3/10

[58] Field of Search ..... 128/463, 479, 480, 481, 128/505, 516, 517; 264/45, 321

[56] References Cited

UNITED STATES PATENTS

| | | | |
|---|---|---|---|
| 2,727,278 | 12/1955 | Thompson | 128/463 X |
| 2,728,079 | 12/1955 | Williams | 128/505 |
| 2,896,631 | 7/1959 | Block | 128/480 X |
| 3,164,655 | 1/1965 | Howard et al. | 128/516 X |
| 3,266,495 | 8/1966 | Sachs | 128/479 |
| 3,280,818 | 10/1966 | Pankey et al. | 128/505 |
| 3,399,678 | 9/1968 | Faron | 128/479 |

*Primary Examiner*—Werner H. Schroeder
*Assistant Examiner*—Moshe I. Cohen
*Attorney, Agent, or Firm*—Jessup & Beecher

[57] ABSTRACT

A soft, pliable, strapless breast support comprised of a plastic foam sandwiched between a soft woven or knitted fabric. The support has a somewhat semi-circular shape with upward extending tabs and a specially contoured upper edge to form a cushioned cup which conforms to the shape of the breast when worn. The fabric is adhesively bonded to the plastic foam and a firm, flat border formed by applying heat under pressure. The border is coated with an adhesive which will adhere to skin.

2 Claims, 3 Drawing Figures

STRAPLESS BREAST SUPPORT

BACKGROUND OF THE INVENTION

This invention relates generally to women's undergarments and more particularly to undergarments for supporting the breasts, known as brassieres.

These undergarments generally provide support with straps around the back and usually also have shoulder straps. Strapless dresses and some summer wear cannot be worn with these undergarments because the straps are unsightly. Undergarments without straps have been proposed, but in order to provide support they, typically, are made from coarse, stiff fabrics which can be uncomfortable to the wearer.

The present invention solves the problem of eliminating the straps while also providing the proper support with a soft, pliable undergarment. The breast support of this invention has a soft, firm border which adhesively attaches to the skin, and a contour-cushioned foam cup partly covering the breast. The strapless bra of the present invention has an elevated inside area which supports the breast. A portion of the breast is shifted in position and the padding replaces the region which is shifted.

It is one object of the present invention to provide a breast support which eliminates the need for straps.

Another object of the present invention is to provide a strapless breast support which is soft and pliable.

These and other objects will be apparent when the description is considered in conjunction with the accompanying drawings.

DETAILED DESCRIPTION OF THE EMBODIMENT OF THE INVENTION

Figure 1:
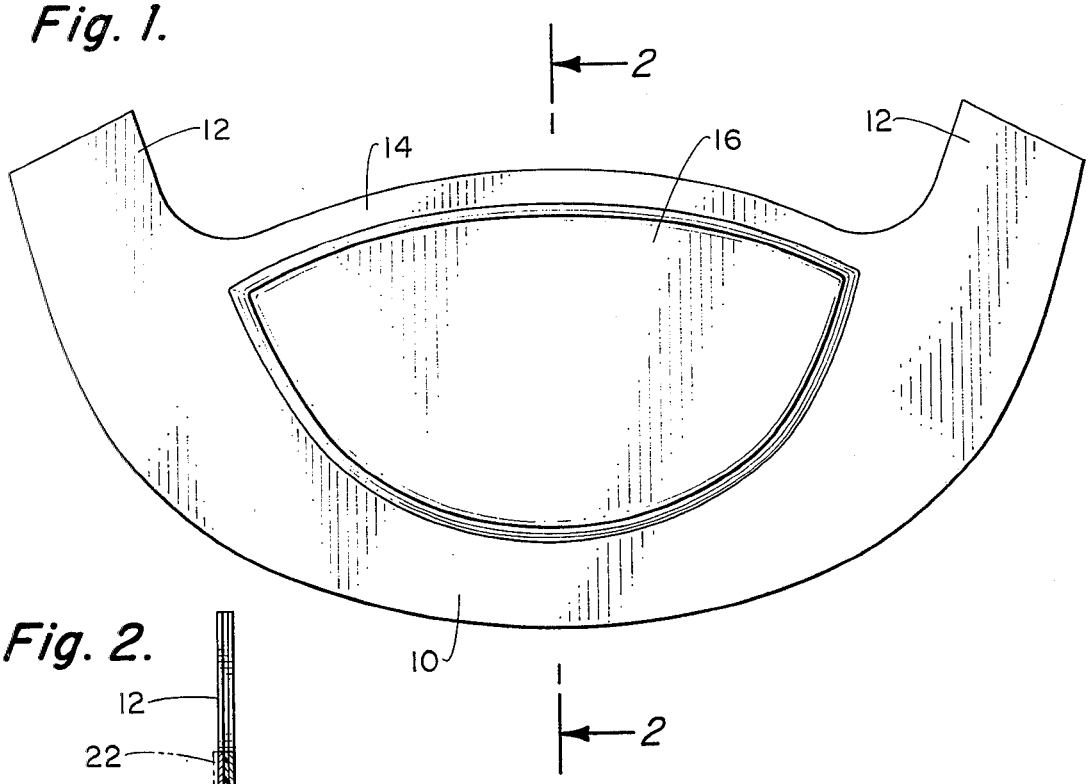
FIG. 1 is a view of the strapless breast support lying flat.

The breast support when not being worn will lie flat, as illustrated in FIG. 1. The breast support has a somewhat semi-circular symmetrical shape formed by a wide flat border 10 curving upward to form two tabs 12. A narrow border 14 slightly curved in the opposite direction of wide border 10 forms a contoured foam cushion 16. The curvature of narrow border 14 is such that the contoured foam cushion 16 forms a cup conforming with the shape of the breast when worn.

Figure 2:
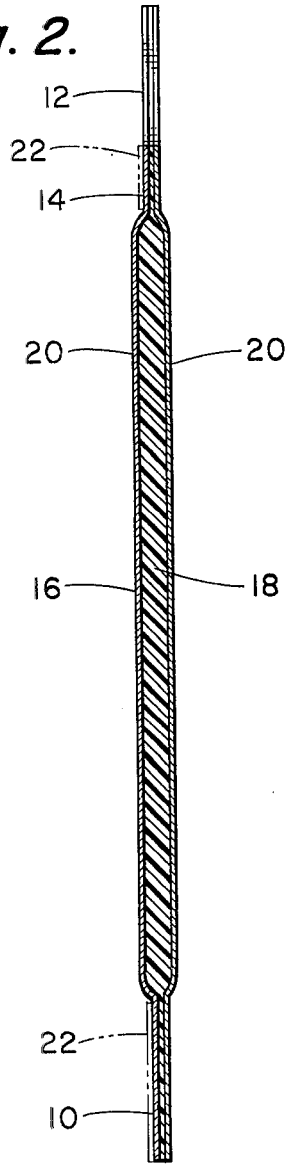
FIG. 2 is a cross-sectional view of the clearly breast support taken on line 2—2.

The construction of the breast support is more clearly shown in FIG. 2. A piece of plastic foam 18, shaped as shown in FIG. 1, is sandwiched between two pieces of soft woven fabric having the same shape and adhesively bonded. The wide border 10, tabs 12 and narrow border 14 are formed by heating and compressing the plastic foam 18 between the knitted or woven fabric pieces 20. This produces a firm, relatively stiff, border needed to provide the proper support. However, the quality of softness and flexibility of the woven fabric and plastic foam necessary to the comfort are still maintained.

The surface of wide border 10 and tabs 12 is next coated with a pressure-sensitive adhesive which will adhere to the skin. The adhesive is a gel comprised of dioctyl phthalate, dibutyl succinate and diethyl azelate.

After application of the adhesive, a contact paper covering 22 is applied to the border for protection until the support is to be used. No adhesive is applied to narrow border 14.

Figure 3:
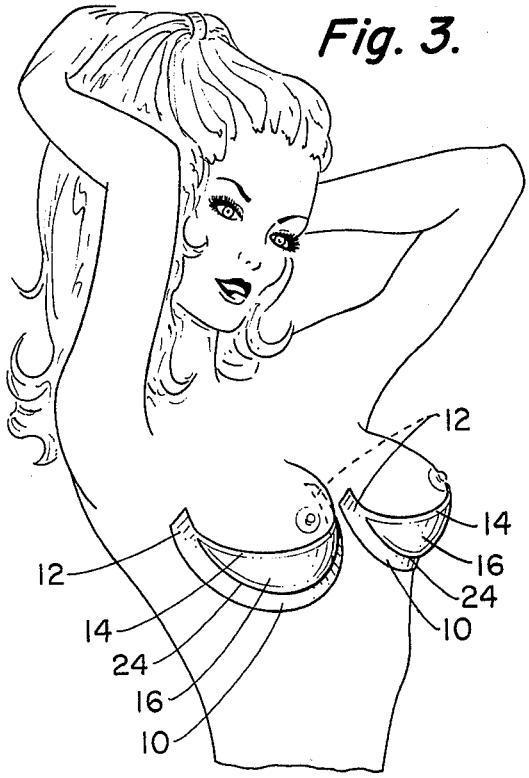
FIG. 3 is a view of the strapless breast support illustrating the manner in which it is worn.

To apply the strapless breast support, contact paper 22 is first peeled off to expose the adhesive on wide border 10. At this time additional adhesive may be applied to border 10 and tabs 12. The support is slipped in and under the lower side of the breast, as shown in FIG. 3, with adhesive border 10 being pressed against the skin. The semi-circular edge 24 of the contour foam cushion 16 follows the line of the breast where it meets the chest. The tabs 12 are then pulled upward with the thumb and forefinger and pressed into position of maximum shaping and uplift. The narrow border 14 will naturally follow the contour of the breast just below the nipple and form foam cushion 16 into a cup.

Since the supports are symmetrical, they can be shifted either way to either separate the breasts or provide maximum cleavage. To provide maximum cleavage, the tab 12 between the breasts would be lowered and the tab 12 pulled higher under the arm. The last step is to firmly press border 10 and tabs 12 all around to assure complete adherence.

Preferably the plastic foam is a flexible polyurethane. The fabric pieces may be made from a tricot which is a warp-knitted fabric noted for it softness and durability. It should be noted that the support is homogeneous in construction. That is, the contour cushion 16, borders 10 and 14, and the tabs 12 are all made from the same plastic foam and fabric, while still providing adequate support without the necessity of adding stiff, coarse materials which may be uncomfortable to the wearer.

Obviously many modifications will occur to those skilled in the art. For example, the contour foam cushion 16 can be made thicker to enhance the beauty of women with small breasts. Obviously the contour cushion can be formed by the heating and compressing process first and then the excess material trimmed away to form the tabs 12 and correct width borders 10 and 14. Nor does the outside edge of the border 10 need to be semi-circular. It is only necessary that the contour cushion have a semi-circular lower edge and oppositely curved upper edge in order to form a cup conforming to the shape of the breast. Therefore within the scope of the appended claims, numerous variations may be practiced other than as specifically described.

What is claimed is:

1. A soft, pliable strapless breast support having a homogeneous construction comprised of:

a flat form having a firm border defining a soft foam contour cushion;

said flat form being comprised of:

first and second pieces of soft, pliable material;

a flexible plastic foam sandwiched between said first and second pieces of fabric;

means bonding said fabric to said plastic foam;

said border defining said contour cushion being formed by heating and compressing said fabric and said foam to produce a wide semi-circular lower border terminating in a pair of upward extending tabs and a narrow upper border slightly curved in the opposite direction from said wide border joining said wide border adjacent to said tabs;

adhesive means comprised of a non-skin sensitive adhesive coated on one side of said wide border whereby when said wide border is pressed against the chest beneath a breast and said tabs pulled upward, said contour cushion cups and supports said breast.

2. The strapless breast support according to claim 1, wherein said adhesive is a gel comprised of dioctyl phthalate, dibutyl succinate and diethyl azelate.

* * * * *